US006919131B2

(12) United States Patent
Koh et al.

(10) Patent No.: US 6,919,131 B2
(45) Date of Patent: Jul. 19, 2005

(54) LATENT-ELASTICITY INTERLACED-TEXTURED YARN AND SUEDE-LIKE ELASTIC WOVEN FABRIC PRODUCED USING THE SAME

(75) Inventors: Joon-seok Koh, Seoul (KR); Si-ryang Park, Seoul (KR); Ik-hyun Kwon, Sihung (KR)

(73) Assignee: Hyosung Corporation, Seoul (KR)

( * ) Notice: Subject to any disclaimer, the term of this patent is extended or adjusted under 35 U.S.C. 154(b) by 0 days.

(21) Appl. No.: 10/765,985

(22) Filed: Jan. 29, 2004

(65) Prior Publication Data

US 2005/0095425 A1 May 5, 2005

(30) Foreign Application Priority Data

Nov. 4, 2003 (KR) ..... 10-2003-0077469

(51) Int. Cl.[7] ..... D01F 8/00
(52) U.S. Cl. ..... 428/370; 428/373; 428/359
(58) Field of Search ..... 428/370, 373, 428/359, 397; 57/243, 244

(56) References Cited

U.S. PATENT DOCUMENTS 5,188,892 A * 2/1993 Grindstaff ..... 428/359
5,250,245 A * 10/1993 Collins et al. ..... 264/103
5,691,057 A * 11/1997 Bennie et al. ..... 428/373
6,689,461 B2 * 2/2004 Koyanagi et al. ..... 428/364

FOREIGN PATENT DOCUMENTS

| | | |
|---|---|---|
| JP | 6-212525 | 8/1994 |
| KR | 1994-0015000 | 7/1994 |
| KR | 1996-0014443 | 5/1996 |
| KR | 2003-0040287 | 2/2003 |

OTHER PUBLICATIONS

English Language Abstract of KR 1994–0015000.
English Language Abstract of JP 6–212525.
English Language Abstract of KR 1996–0014443.
English Language Abstract of KR 2003–0040287.

* cited by examiner

*Primary Examiner*—N. Edwards
(74) *Attorney, Agent, or Firm*—Greenblum & Bernstein, P.L.C.

(57) ABSTRACT

Disclosed is a potentially elastic Interlaced-textured yarn including a potentially crimped yarn and a composite filaments interlaced with each other, and an elastic woven fabric produced using the same. The potentially elastic interlaced-textured yarn is produced by interlacing the PET/PTT polyester-based potentially crimped yarn with an ultrafine yarn having a monofilament fineness after the weight reduction by alkali treatment of 0.01 to 0.5 deniers and a total fineness of 30 to 300 deniers. At this time, the ultrafine yarn is selected from the group consisting of a sea-island type composite filaments, a radial type composite filaments, and a yarn produced through a direct spinning process. Furthermore, the potentially elastic interlaced-textured yarn has elasticity of 15 to 40%, and the woven fabric has superior elastic recovery, elasticity recovery, drape, and dyeability, in addition having soft, suede-like texture.

8 Claims, 1 Drawing Sheet

LATENT-ELASTICITY INTERLACED-TEXTURED YARN AND SUEDE-LIKE ELASTIC WOVEN FABRIC PRODUCED USING THE SAME

BACKGROUND OF THE INVENTION

1. Field of the Invention

The present invention pertains, in general, to a latent-elasticity interlaced-textured yarn and an elastic woven fabric produced using the same. More particularly, the present invention relates to a latent-elasticity interlaced-textured yarn produced by air-interlacing latent-crimped filaments with composite filaments, and an elastic woven fabric produced using the same. At this time, the latent-crimped filaments have the latent elasticity resulting from the conjugate spinning of two kinds of polymers with differ rent thermal shrinkages, and the ultrafine filaments are selected from the group consisting of ultrafine filaments produced through a direct spinning process, or sea-island type or radial type composite filaments. Additionally, latent-elasticity interlaced-textured yarns are woven, weight-reduced and subjected to an after-treatment to produce the elastic woven fabric with superior resilience, drape, elasticity, and elastic recovery.

2. Description of the Related Art

A conventional elastic woven fabric using a false twisted yarn disclosed in Korean Pat. Laid-Open Publication No. 1994-15000 is disadvantageous in that the elasticity and elastic recovery of the conventional elastic woven fabric are poor because of a limit of the elasticity of the false twisted yarn.

In addition, Japanese Pat. Laid-Open Publication No. Hei. 6-212525 suggests an elastic fancy-yarn which includes a polyurethane filaments (spandex) as a core yarn and a cut fiber spun yarn as an effect yarn.

However, a woven fabric-produced using the above elastic fancy yarn has some disadvantages.

In other words, a stretching (lowering of elasticity) of the spandex occurs at a relatively high temperature ranging from 110 to 130° C. during a dip dyeing process of the elastic fancy yarn, and particularly, the occurrence of the stretching is more frequent when the spandex is repeatedly dyed, causing an increase of a percent defective of the elastic fancy yarn.

The stretching of the spandex is also caused by the tension repeatedly being applied to the spandex in the wearing of the spandex cloths Further, a conventional filament and cut fiber composite yarn without a spandex, or a false twisted filaments, or a potentially crimped filaments has a disadvantage of the poor elasticity of a woven fabric after dyeing and finishing process, which is recited in Korean Pat. Laid-Open Publication No. 1996-14443.

Furthermore, Korean Pat. Laid-Open Publication No. 2003-0040287 discloses a filaments and cut fiber composite yarn with a core-sheath structure including a potentially crimped filaments and a cut fiber spun yarn. However, this patent is disadvantageous in that it is difficult to collect the cut fibers during a ring spinning process and a twisting process is very complicated.

SUMMARY OF THE INVENTION

Accordingly, the present invention has been made keeping in mind the above problems occurring in the prior art, and an aspect of the present invention is to provide a latent-elasticity interlaced-textured yarn which is easily produced and has superior elasticity and elastic recovery after the treatment at a high temperature during dyeing process, and a woven fabric woven using the latent-elasticity interlaced-textured yarn and dyed, which has superior resilience, drape, elasticity, and elastic recovery. At this time, the woven fabric secures various desired properties, for example, the woven fabric has the suede-like soft texture after a raising process, because a composite yarn constituting the woven fabric becomes extremely fine.

The present invention is also directed to a latent-elasticity interlaced-textured yarn, comprising one ply of latent-crimp conjugated yarn of 20 to 300 denier, which includes two kinds of polymers having different thermal shrinkages and which has a monofilament fineness of 1–6 denier; and one or two plies of ultrafine yarn of 30–300 denier having a monofilament fineness of 0.01–0.5 denier after a weight loss process or a solvent treatment process, or after production through a direct spinning process and which are interlaced with said latent-crimp conjugated yarn using air under pressure. The present invention is also directed to an elastic suede-like woven fabric comprising the latent-elasticity interlaced-textured yarn.

BRIEF DESCRIPTION OF THE DRAWINGS

This and other aspects and advantages of the invention-will become apparent and more readily appreciated from the following description of the preferred embodiments, taken in conjunction with the accompanying drawing of which.

DETAILED DESCRIPTION OF THE PREFERRED EMBODIMENTS

Reference will now be made in detail to the present preferred embodiments of the present invention, examples of which are illustrated in the accompanying drawings.

A detailed description will be given of a potentially elastic latent-elasticity interlaced-textured yarn according to the present invention, below.

Figure 1:
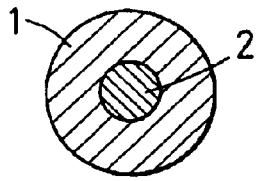
FIG. 1 is an enlarged cross-sectional view of latent-elasticity interlaced-textured yarn according to the present invention.

With reference to FIG. 1, the latent-elasticity interlaced-textured yarn of the present invention includes a latent-crimped polyester-based filaments 2 with a monofilament fineness of one to six deniers and a multifilament fineness of 20 to 300 deniers.

The latent-elasticity interlaced-textured yarn also includes composite filaments 1 with a monofilament fineness of 0.01 to 0.5 deniers and a multifilament fineness of 30 to 300 deniers after the composite filaments are reduced in weight under an alkaline environment.

In this respect, the latent-elasticity interlaced-textured yarn includes 10 to 40 wt % latent crimped polyester-based filaments 2 based on a total weight of the latent-elasticity interlaced-textured yarn, and is interlaced under air pressure of one to five kgf/cm$^2$.

For example, when the multifilament fineness of the latent-crimped filaments 2 is less than 20 deniers the elasticity of a woven fabric is poor. On the other hand, when the multifilament fineness of the crimped filaments 2 is more than 300 deniers, a combination of the latent-crimped filaments 2 and sea island or radial type composite filaments 1 is too heavy to be applied as a grey yarn of the woven fabric for cloths.

According to the present invention, the latent-crimped filaments 2 are produced by conjugate-spinning the two kinds of polymers with different thermal shrinkages in a side-by-side (refer to FIG. 2) or a sheath-core manner, and physically forming a coil-shaped crimp with the use of a thermal shrinkage difference between the polymers when the polymers are heated during a spinning process or a drawing process. At this time, the latent-crimped filaments 2 have superior elasticity due to their shape, which is similar to a spring.

Figure 2:
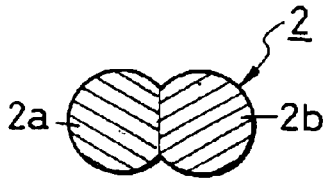
FIG. 2 is an enlarged cross-sectional view of latent-crimped polyester filaments including polyethylene terephthalate and polytrimethylene terephthalate used in the present invention.
Figure 3:
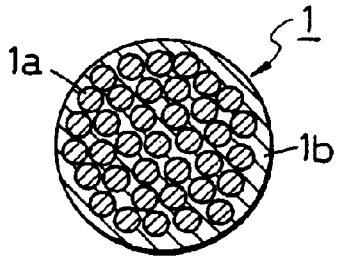
FIG. 3 is an enlarged cross-sectional view of a sea-island type composite filaments used in the present invention.

Examples of the latent-crimped filaments 2 used in the latent-elasticity interlaced-textured yarn according to the present invention may include side-by-side type composite filaments consisting of polyethylene terephthalate (hereinafter, referred to as 'PET') and polytrimethylene terephthalate (hereinafter, referred to as 'PTT') as shown in FIG. 2. The sea-island type composite filaments 1 used in the present invention is produced by conjugate-spinning or blend-inning of two polymers, to be used to produce filaments, in a sea-island manner. In this respect, nylon-6 or PET is used as an island component 1*a*, and copolymer polyester, polystyrene, or polyethylene, having a different solubility from the island component 1*a*, is used as a sea component 1*b*. Particularly, in the present invention, copolyester is preferably used as the sea component 1*b* because when polystyrene or polyethylene is used as the sea component 1*b*, toluene or perchloro ethylene is used as a solvent. Meanwhile, the sea-island type composite filaments 1 used in the present invention is illustrated in FIG. 3, and may have any sectional shape.

Furthermore, the fineness (i.e. fineness of an insoluble component) of the sea-island type composite filaments 1 is 0.5 deniers or less after it is subjected to a weight reduction treatment to be very fine, and the preferable softness, tenacity, and sense of density are secured as the fineness is lowered.

Figure 4:
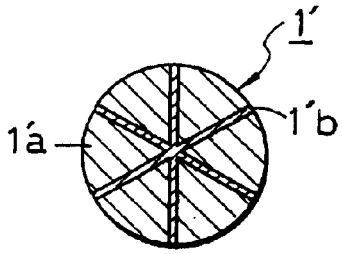
FIG. 4 is an enlarged cross-sectional view of a radial type composite filaments used in the present invention.

A radial type composite filaments 1' used in the present invention is produced by conjugate-spinning or blend-spinning of two polymers, which are to be used to produce filaments, in a radial pattern (Refer to FIG. 4). In this regard, a fan-shaped section 1'*a* of the radial type composite filaments 1' is made of nylon-6 or PET, and examples of a material constituting a boundary line part 1'*b* of the radial type composite filaments 1' is made of copolyester, polystyrene, or polyethylene which has different solubilities from the fan-shaped section 1'*a*. Further, the fineness (i.e. fineness of the insoluble component) of the radial type composite filaments 1' is 0.5 deniers or less after it becomes very fine, and the preferable softness, tenacity, and sense of density are secured as the fineness becomes lowered.

Meanwhile, an ultrafine filaments produced according to a direct spinning process is a yarn consisting of a single component such as polyester or nylon, and has the fineness (i.e. fineness of the insoluble component) of 0.1 to 0.5 deniers. At this time, the preferable softness, tenacity, and sense of density are secured as the fineness of the ultrafine filaments becomes lowered. At this time, the ultrafine filaments produced according to the direct spinning process may have any sectional shape.

A latent-crimped filaments content in the latent-elasticity interlaced-textured yarn is preferably 11 to 67 wt % based on a weight of the sea island 1 or radial type composite filaments 1', thereby a better latent-elasticity interlaced-textured yarn is produced.

For example, when the latent-crimped filaments content is less than 11 wt %, the elasticity of the plastic latent-elasticity interlaced-textured yarn is poor. On the other hand, when the latent-crimped filaments content is more than 67 wt %, the protrusion of the latent-crimped filaments 2 from a surface of the latent-elasticity interlaced-textured yarn starts to be prominent.

A condition of an air pressure during an interlacing process is determined in conformity to a kind of the selected filaments to provide the uniform interlacing property to the yarn and suppress the occurrence of capillary. In the case of using a grey yarn comprised of a large number of filaments each having a small fineness, it is preferable that the air pressure is 2 to 3 kgf/cm$^2$. On the other hand, in the case of using the grey yarn comprised of a small number of filaments each having a large fineness, the air pressure is preferably 3 kgf/cm$^2$ or more.

A weaving process is conducted using the latent-elasticity interlaced-textured yarn as the grey yarn to produce a grey fabric, and the grey fabric thusly produced is subjected to a dry heat setting process from 150 to 190° C. for 20 to 60 seconds using a heater with uniform heat distribution, thereby being expanded by 20%, in comparison with the width prior to the heat treatment. At this time, an over feed ratio is 3 to 25%. The expanded grey fabric is again subjected to the dry heat setting process at 150 to 190° C. for 20 to 60 seconds to stabilize a dimension thereof, after it is subjected to a scouring, a weight reducing, a contracting process, a dyeing, and a raising process in order.

When the dry heat setting process is conducted at temperatures lower than 150° C., the dimensional stability of the latent-elasticity interlaced-textured yarn is poor. On the other hand, when the dry heat 20 setting process is conducted at temperatures higher than 190° C.,the elasticity and texture of the latent-elasticity interlaced-textured yarn are reduced.

Furthermore, when the dry heat setting process is conducted for less than 20 seconds, the dimensional stability of the latent-elasticity interlaced-textured yarn is poor. On the other hand, when the dry heat setting process is conducted for more than 20 seconds, its elasticity and texture are reduced.

As described above, the woven grey fabric using the latent-elasticity interlaced-textured yarn according to the present invention is subjected to the above processes to form crimps on the latent-elasticity interlaced-textured yarn. Thereby, the latent-elasticity interlaced-textured yarn has superior elasticity of 15 to 40%, elastic recovery of 85% or more, resilience, and drape. Additionally, it has soft texture because of the ultrafine filaments formed by weight reduction treatment of the sea-island or radial type composite filaments 1 and 1'.

The latent-crimped filaments 2 are composite filaments including two kinds of polymers, that is, PET and PTT, as described above. In this respect, PTT has superior dyeability for dark colors at a lower temperature by 20° C. than PET during a dyeing process, and also has the lower modulus than PET in views of a molecular structure, thus PTT is softer than PET. Accordingly, the latent-crimped filaments 2 have superior dyeability and softness.

Having generally described this invention, a further understanding can be obtained by reference to examples and comparative examples which are provided herein for purposes of illustration only and are not intended to be limiting unless otherwise specified.

Physical properties of a woven fabric produced using a latent-elasticity interlaced-textured yarn according to the present invention were measured as follows.

(1) Elongation and elongation recovery

The elongation of the woven fabric was measured according to a JIS L 1096 B method (static load method).

The elongation recovery of the woven fabric was measured according to a JIS L 1096 B-1 method (static load method).

(2) Surface effect of the woven fabric (stretching of the woven fabric: sag phenomenon)

A sample with a size of 7.5 cm ×30 cm was secured by a clamp and extended for 10 seconds in a load of 5 KG using an Ultimate Tensile strength Measuring device(UTM) according to KSK 0520 method. After 10 minutes since the load is removed, an appearance of the sample was observed to evaluate the surface effect of the woven fabric as follows:

◎: nine to ten points, ○: seven to eight points, Δ: five to six points, ×: five or lower points (based on 10 points as a full mark)

(3) Elasticity after a re-dyeing process

The primarily treated woven fabric was dyed at a relatively high temperature of 130°C. and in a humid environment for 30 minutes using a liquid dyeing machine, and its elasticity was measured according to a KSK 0352 5.2.2 method.

EXAMPLE 1

One ply of PTT latent-crimped filaments 2 having the monofilament fineness of 2.1 deniers and the total fineness of 75 deniers was interlaced with two plies of sea-island type composite filaments 1 having the monofilament fineness before the weight reduction of 2.1 deniers, the monofilament fineness after the weight reduction of 0.04 deniers, and the multifilament fineness of 75 deniers using an air pressure of 3 kgf/cm$^2$ in an overfeed ratio of 3% to produce a latent-elasticity interlaced-textured yarn of 225 deniers.

A polyester false twisted yarn of 75 deniers as a warp and the latent-elasticity interlaced-textured yarn as a weft were woven in satin weave using a Rapier loom, and then sequentially subjected to a continuous rinsing, a weight reducing, and contraction, a pre-set, a dyeing, a final set, and a raising or a buffing process in order.

The elasticity and elastic recovery of the resulting woven fabric were each measured ten times according to the methods as described above, and then compared with those of a conventional spandex fabric. The results are described in Table 1.

EXAMPLE 2

The procedure of Example 1 was repeated except that the polyester false twisted yarn and latent-elasticity interlaced-textured yarn were woven in plain weave.

EXAMPLE 3

The procedure of Example 1 was repeated except that PET/PTT latent-crimped filaments having the monofilament fineness of 2.1 deniers and the multifilament fineness of 75 deniers was used as the warp.

EXAMPLE 4

One ply of PET/PTT latent-crimped filaments 2 having the monofilament fineness of 2.1 deniers and the multifilament fineness of 75 deniers was interlaced with two plies of radial type composite filaments 1' having the monofilament fineness of 2.5 deniers and the multifilament fineness of 90 deniers (regular PET/easily soluble PET, and the monofilament fineness after separation process was 0.3 deniers) using an air pressure of 3 kgf/cm$^2$ in an overfeed ratio of 3% to produce a latent-elasticity interlaced-textured yarn of 255 deniers.

A polyester false twisted yarn of 75 deniers as a warp and the latent-elasticity interlaced-textured yarn as a weft were woven in satin weave using a Rapier, and then sequentially subjected to a continuous rinsing, a weight reducing and contraction, a pre-set, a dyeing, a final set, and a raising or a buffing process in order.

EXAMPLE 5

The procedure of Example 1 was repeated except that the monofilament fineness of the radial type composite filaments 1' before and after the separation process were 2.5 and 0.3 deniers, respectively, and the multifilament fineness of the radial type composite filaments 1' was 120 deniers.

EXAMPLE 6

One ply of PET/PTT latent-crimped filaments 2 having the monofilament fineness of 2.1 deniers and the multifilament fineness of 75 deniers was interlaced with one ply of ultrafine yarn, produced according to a direct spinning process, having the monofilament fineness of 0.32 deniers and the multifilament fineness of 204 deniers using an air pressure of 3 kgf/cm$^2$ in an overfeed ratio of 3% to produce a latent-elasticity interlaced-textured yarn of 279 deniers.

A polyester false twisted yarn of 75 deniers as a warp and the latent-elasticity interlaced-textured yarn as a weft were woven in satin weave using a Rapier loom, and then sequentially subjected to a continuous rinsing, a weight reducing and contraction, a pre-set, a dyeing, and a final set process in order.

EXAMPLE 7

The procedure of Example 1 was repeated except that the multifilament fineness of the PET/PTT latent-crimped filaments 2 was 150 deniers.

EXAMPLE 8

One ply of PET/PTT latent-crimped filaments 2 having the monofilament fineness of 3.3 deniers and the multifilament fineness of 30 deniers was interlaced with one ply of sea-island type composite filaments 1 having the monofilament fineness before the weight reduction of 2.1 deniers, the monofilament fineness after the weight reduction of 0.04 deniers, and the multifilament fineness of 75 deniers using an air pressure 5 of 3 kgf/cm$^2$ in an overfeed ratio of 3% to produce a latent-elasticity interlaced-textured yarn of 105 deniers.

The latent-elasticity interlaced-textured yarn as a warp and the PET/PTT latent-crimped filaments having the monofilament fineness of 2.1 deniers and the multifilament fineness of 150 deniers as a weft were woven in satin weave using a Rapier loom, and then sequentially subjected to a continuous rinsing, a weight reducing and contraction, a pre-set, a dyeing, a final set, and a raising or a buffing process in order.

COMPARATIVE EXAMPLE 1

A polyester false twisted yarn of 75 deniers as interlaced textured yarn for med of a sea-island type composite filaments having the monofilament fineness of 2.1 deniers and the multifilament fineness of 75 deniers and a high shrinkage filaments having the 20 monofilament fineness of 2.5 deniers and the deniers as a weft were woven in satin weave using a Rapier loom, and then sequentially subjected to a continuous rinsing, a weight reducing and contraction, a pre-set, a dyeing, a final set, and a raising or a buffing process in order.

COMPARATIVE EXAMPLE 2

The procedure of Example 1 was repeated except that a polyester false twisted yarn having the monofilament fineness of 2.1 deniers and the multifilament fineness of 75 deniers was used instead of the sea-island type composite filaments.

COMPARATIVE EXAMPLE 3

The procedure of Example 1 was repeated except that a fancy yarn including 70 deniers spandex as a core yarn and polyester yarn of 150 deniers as a sheath yarn was used as a weft.

TABLE 1

| | Ex. 1 | Ex. 2 | Ex. 3 | Ex. 4 | Ex. 5 | Ex. 6 | Ex. 7 | Ex. 8 | Co. Ex. 1 | Co. Ex. 2 | Co. Ex. 3 |
|---|---|---|---|---|---|---|---|---|---|---|---|
| Elongation (%) | 32 | 27 | 30 | 34 | 30 | 34 | 34 | 35 | 0 | 29 | 41 |
| Eelongation recovery (%) | 94 | 96 | 96 | 92 | 91 | 90 | 89 | 92 | — | 89 | 86 |
| Elasticity after the re-dyeing (%) | 30 | 26 | 29 | 32 | 29 | 31 | 32 | 33 | — | 28 | 21 |
| Surface effect (sag phenomenon) | ◎ | ◎ | ◎ | ◎ | ◎ | ◎ | ◎ | ◎ | ◎ | ◎ | Δ |
| Appearance | ◎ | ○ | ◎ | ○ | ◎ | ○ | ○ | ○ | Δ | Δ | ◎ |
| Texture | ◎ | ○ | ◎ | ○ | ○ | ○ | Δ | ◎ | ○ | Δ | Δ |

As apparent from the above description, the present invention provides a latent-elasticity interlaced-textured yarn and an elastic suede-like woven fabric produced using the same. In this respect, the woven fabric produced using the latent-elasticity interlaced-textured yarn of the present invention has superior elasticity, and better recovery than a conventional spandex fabric, thus a stretching (sag phenomenon) rarely occurs in the woven fabric of the present invention in wearing the clothes. Additionally, the woven fabric of the present invention has superior dyeability and color fastness, and is not reduced in terms of elasticity after it is dyed several times, causing a decrease of a percent defective thereof, in addition to being easily produced and securing a soft texture due to a ultrafine filaments produced through a direct spinning process, or an ultrafine sea island or radial type composite filaments constituting the woven fabric.

The present invention has been described in an illustrative manner, and it is to be understood that the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A latent-elasticity interlaced-textured yarn, comprising:

one ply of latent-crimp conjugated yarn of 20 to 300 denier, wherein the yarn includes a composite filament which includes two kinds of polymers having different thermal shrinkages and which has a monofilament composite filament fineness of 1–6 denier; and one or two plies of ultrafine yarn of 30–300 denier having a monofilament fineness of 0.01–0.5 denier after a weight loss process or an alkaline solvent treatment process, or after production through a direct spinning process and which are interlaced with said latent-crimp conjugated yarn using air under pressure.

2. The latent-elasticity interlaced-textured yarn as set forth in claim 1, wherein the latent-crimped yarn comprises side-by-side composite filaments having two kinds of polymers including polyethylene terephthalate and polytrimethylene terephthalate.

3. The latent-lasticity interlaced-textured yarn as set forth in claim 1, wherein the ultrafine yarn is selected from the group consisting of sea-island composite filaments, radial composite filaments and a very fine yarn produced through a direct spinning process.

4. The latent-elasticity interlaced-textured yarn as set forth in claim 1, wherein a latent-crimped yarn content is 11 to 67 wt % based on a weight of the ultrafine yarn.

5. An elastic suede-like woven fabric with elongation of 10 to 40% and elongation recovery of 80% or more, comprising the latent-elasticity interlaced-textured yarn as sent forth in claim 1.

6. An elastic suede-like woven fabric with elongation of 10 to 40% and elongation recovery of 80% or more, comprising the latent-elasticity interlaced-textured yarn as sent forth in claim 2.

7. An elastic suede-like woven fabric with elongation of 10 to 40% and elongation recovery of 80% or more, comprising the latent-elasticity interlaced-textured yarn as sent forth in claim 3.

8. An elastic suede-like woven fabric with elongation of 10 to 40% and elongation recovery of 80% or more, comprising the latent-elasticity interlaced-textured yarn as sent forth in claim 4.

* * * * *

UNITED STATES PATENT AND TRADEMARK OFFICE

CERTIFICATE OF CORRECTION

PATENT NO. : 6,919,131 B2
DATED : July 19, 2005
INVENTOR(S) : J. Koh et al.

It is certified that error appears in the above-identified patent and that said Letters Patent is hereby corrected as shown below:

Column 7,
Line 50, delete "monofilament".

Signed and Sealed this

Seventh Day of February, 2006

JON W. DUDAS
*Director of the United States Patent and Trademark Office*